US012305902B2

(12) United States Patent
Leys

(10) Patent No.: US 12,305,902 B2
(45) Date of Patent: May 20, 2025

(54) CONTAINER FOR FREEZING LIQUIDS

(71) Applicant: Jeffrey Lynn Leys, Clinton, MI (US)

(72) Inventor: Jeffrey Lynn Leys, Clinton, MI (US)

( * ) Notice: Subject to any disclaimer, the term of this patent is extended or adjusted under 35 U.S.C. 154(b) by 0 days.

(21) Appl. No.: 18/760,699

(22) Filed: Jul. 1, 2024

(65) Prior Publication Data

US 2025/0012500 A1 Jan. 9, 2025

Related U.S. Application Data

(60) Provisional application No. 63/628,257, filed on Jul. 5, 2023.

(51) Int. Cl.
*F25C 1/22* (2018.01)

(52) U.S. Cl.
CPC ..... *F25C 1/22* (2013.01); *F25C 2400/08* (2013.01)

(58) Field of Classification Search
CPC ..... F25C 1/243; F25C 1/22; F25C 2400/08; F25D 2331/8015; F25D 2331/8014; A61F 2007/108; B65D 81/3266; B65D 77/08; B65D 31/12
See application file for complete search history.

(56) References Cited

U.S. PATENT DOCUMENTS

| | | | | |
|---|---|---|---|---|
| 2,083,081 | A | 10/1935 | Moll | |
| 5,971,352 | A | 10/1999 | Kirks | |
| 6,345,802 | B2 | 2/2002 | Moore | |
| 6,637,721 | B1 | 10/2003 | Zonca | |
| D482,374 | S | 11/2003 | Fan | |
| 2002/0153468 | A1* | 10/2002 | Folkmar | F25C 1/243 249/105 |
| 2004/0075038 | A1 | 4/2004 | Hang | |
| 2008/0245800 | A1 | 10/2008 | Moore | |
| 2016/0145030 | A1* | 5/2016 | Malligan | A23L 25/20 426/120 |

FOREIGN PATENT DOCUMENTS

CN 209796233 U * 12/2019

OTHER PUBLICATIONS

English language machine translation of CN209796233 (Year: 2019).*

* cited by examiner

*Primary Examiner* — Cassey D Bauer
(74) *Attorney, Agent, or Firm* — Gardner, Linn, Burkhart & Ondersma LLP

(57) ABSTRACT

A container for freezing liquids and storing ice has a chamber defining multiple regions to improve ice-making by forming and storing ice simultaneously and facilitating the transfer of ice between a freezing region and a storing region of the container without introducing new contaminants. The regions are separable by a reclosable divider fastener that, when closed, isolates liquid in the freezing region from ice in the storing region. Ice frozen in the freezing region can be sanitarily transferred to the storing region, such as by opening the reclosable divider fastener by grasping and manipulating only the exterior portions of the container. Optionally, the container may be designed to allow forming multiple batches of ice in the freezing region and moving them into the storing region until ready for use.

20 Claims, 14 Drawing Sheets

CONTAINER FOR FREEZING LIQUIDS

CROSS REFERENCE TO RELATED APPLICATION

The present application claims the benefit of U.S. provisional patent application Ser. No. 63/628,257 filed Jul. 5, 2023, which is hereby incorporated herein by reference in its entirety.

FIELD OF THE DISCLOSURE

The present disclosure relates to freezing liquids and, more particularly, to a container for freezing liquids.

BACKGROUND

Freezing liquids (e.g., water) to ice is useful for applications at home and in various industries such as, for example, the food and beverage industry and the healthcare industry. In some cases, ice is used to cool beverages, and to preserve temperature-sensitive foods, beverages, and medications that are used by people such that there is a need or desire to ensure the sanitation of this ice. Different sizes of ice may be preferred based on its application. For instance, when slower-melting ice is desired, a larger block of ice may be used, and when faster cooling of items is desired, smaller pieces of ice may be used.

SUMMARY

A container for freezing liquids and storing ice improves ice-making by having the capability to simultaneously store and freeze ice, and sanitarily transfer ice within the container. The container has a chamber defining regions that can be designated for storing and/or freezing ice. For example, one of the regions may be designated as a freezing region, and another region may be designated as a storing region that is selectively isolated from the freezing region. To accomplish this, the container has a reclosable divider fastener that selectively separates the regions. For example, after liquids enter the freezing region for forming ice, the reclosable divider fastener can be closed so that ice can enter the storing region for storing such ice without contacting the liquids. Ice and liquids can be transferred between regions by manually grasping and manipulating the exterior portions of the container to open the reclosable divider fastener in a sanitary manner. The container may have a reclosable port fastener coupled to a portion of the chamber defining the freezing region so that liquids can enter the freezing region without entering the storing region, and ice can be iteratively produced while reducing risk of contamination. Both regions may be designated as freezing regions and vary in the presence of obstructions (e.g., barriers) so that different sizes of ice can form simultaneously in the respective regions.

In one form of the present disclosure, a container for freezing liquids has a chamber that has first and second chamber portions that define first and second regions between first and second lateral sides of the chamber. The chamber has a reclosable divider fastener extending from the first lateral side to the second lateral side and disposed between first and second chamber portions. The reclosable divider fastener can be closed to divide or isolate the first region from the second region. The container has a barrier in the first region. The barrier is coupled to the chamber and defines cavities that can separate liquid between the cavities.

The container has a reclosable port fastener coupled to the chamber. The reclosable port fastener is openable to define a port to receive the liquid from outside of said chamber.

In one aspect, the barrier extends from a first opposing end of the chamber towards the reclosable divider fastener to an endpoint of the barrier that does not reach the reclosable divider fastener.

In another aspect, the reclosable port fastener is coupled to a second opposing end and extends from the first lateral side to the second lateral side.

In yet another aspect, the reclosable port fastener is coupled to the first chamber portion. The container has an additional reclosable port fastener coupled to the second chamber portion. The additional reclosable port fastener is openable to define a port configured to receive liquid from outside of said chamber.

In yet another aspect, the container has a neck extending outwardly from the first chamber portion. The first reclosable port fastener is coupled to the chamber via the neck.

In yet another aspect, the first reclosable port fastener extends along the first lateral side, and the second reclosable port fastener is aligned with the reclosable divider fastener.

In yet another aspect, the reclosable divider fastener has first and second panels. The chamber has first and second sidewalls extending between the lateral sides and cooperating to define the chamber. The first sidewall has the first panel, and the second sidewall has the second panel that is aligned with the first panel. The reclosable divider fastener can close by folding the chamber about a first axis that extends through the first and second lateral sides.

In yet another aspect, the first and second panels are first and second lower panels. The first sidewall has first middle and upper panels, and the second sidewall has second middle and upper panels that are aligned with the first middle and upper panels, respectively. The chamber folds between the first lower and middle panels and between the second lower and middle panels when folding about the first axis. The reclosable divider fastener can also be closed by folding the chamber about a second axis extending through the first and second lateral sides. The chamber folds between the first middle and upper panels and between said second middle and upper panels when folding about the second axis.

In yet another aspect, the container has a handle coupled to the first sidewall. The handle extends along the first axis and can support the container when folding the chamber.

In yet another aspect, the reclosable divider fastener has first and second panel fasteners coupled to the first and second panels, respectively. The first and second panel fasteners can be interlocked when the reclosable divider fastener is closed.

In yet another aspect, the reclosable port fastener is made up of a first pair of strips that can be interlocked with one another when the reclosable port fastener is closed. The reclosable divider fastener is made up of a second pair of strips that can be interlocked with one another when the reclosable divider fastener is closed.

In yet another aspect, the first pair of strips are aligned with the second pair of strips.

In yet another aspect, the reclosable port fastener is coupled to the second chamber portion. Another reclosable port fastener is coupled to the first chamber portion and is made up of a third pair of strips that can be interlocked with one another when it is closed.

In yet another aspect, the reclosable port fastener is coupled to a first opposing end of the chamber. The container has a second port fastener that is coupled to a lateral side of the chamber. The container has a third port fastener coupled to a second opposing end of the chamber.

In yet another aspect, the barrier extends from the second opposing end towards the reclosable divider fastener, and the open third reclosable port fastener defines a port that is aligned with one of the cavities.

In yet another aspect, the first region has an open area that extends between the endpoint of the barrier to the reclosable divider fastener, and the second reclosable port fastener extends along the open area. The open third reclosable port fastener defines a port that is aligned with one of the cavities.

Thus, the container improves the versatility of ice-making by having a chamber defining multiple regions so that liquids can freeze in one region while storing ice in another region, and different sizes of ice can form simultaneously. The container also improves sanitation of ice-making by allowing ice and liquids to transfer between regions without exposing them to contaminants from outside of the chamber. The container may have a reclosable port fastener coupled to a portion of the chamber that defines a freezing region so that liquids can enter the freezing region without contacting ice in a storing region to improve sanitation of iterative ice-making.

These and other objects, advantages, purposes, and features of this disclosure will become apparent upon review of the following specification in conjunction with the drawings.

DESCRIPTION OF THE PREFERRED EMBODIMENTS

Figure 1:
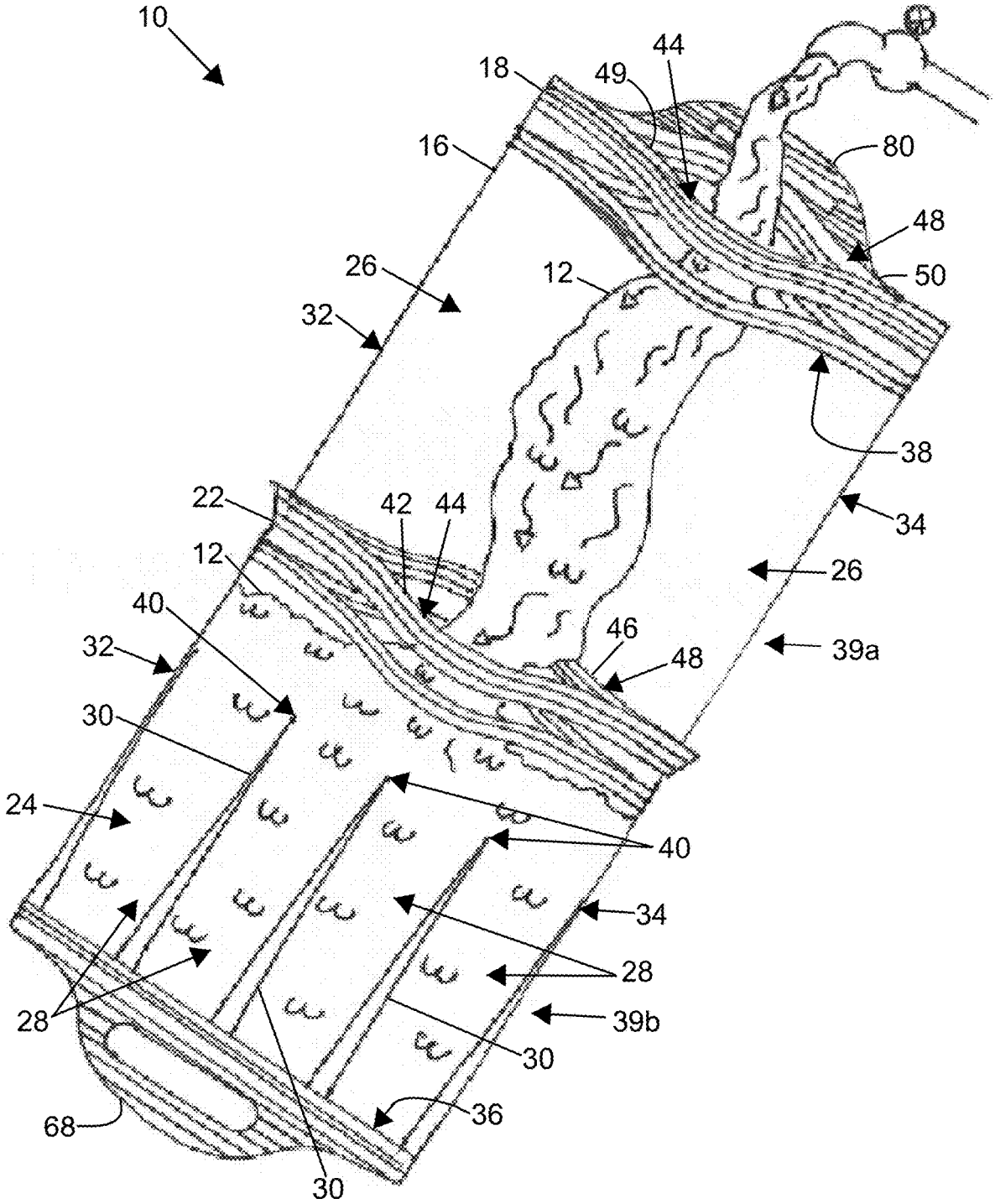
FIG. 1 is a perspective view of a container having a reclosable main port fastener and a reclosable divider fastener, both shown open.
Figure 2:
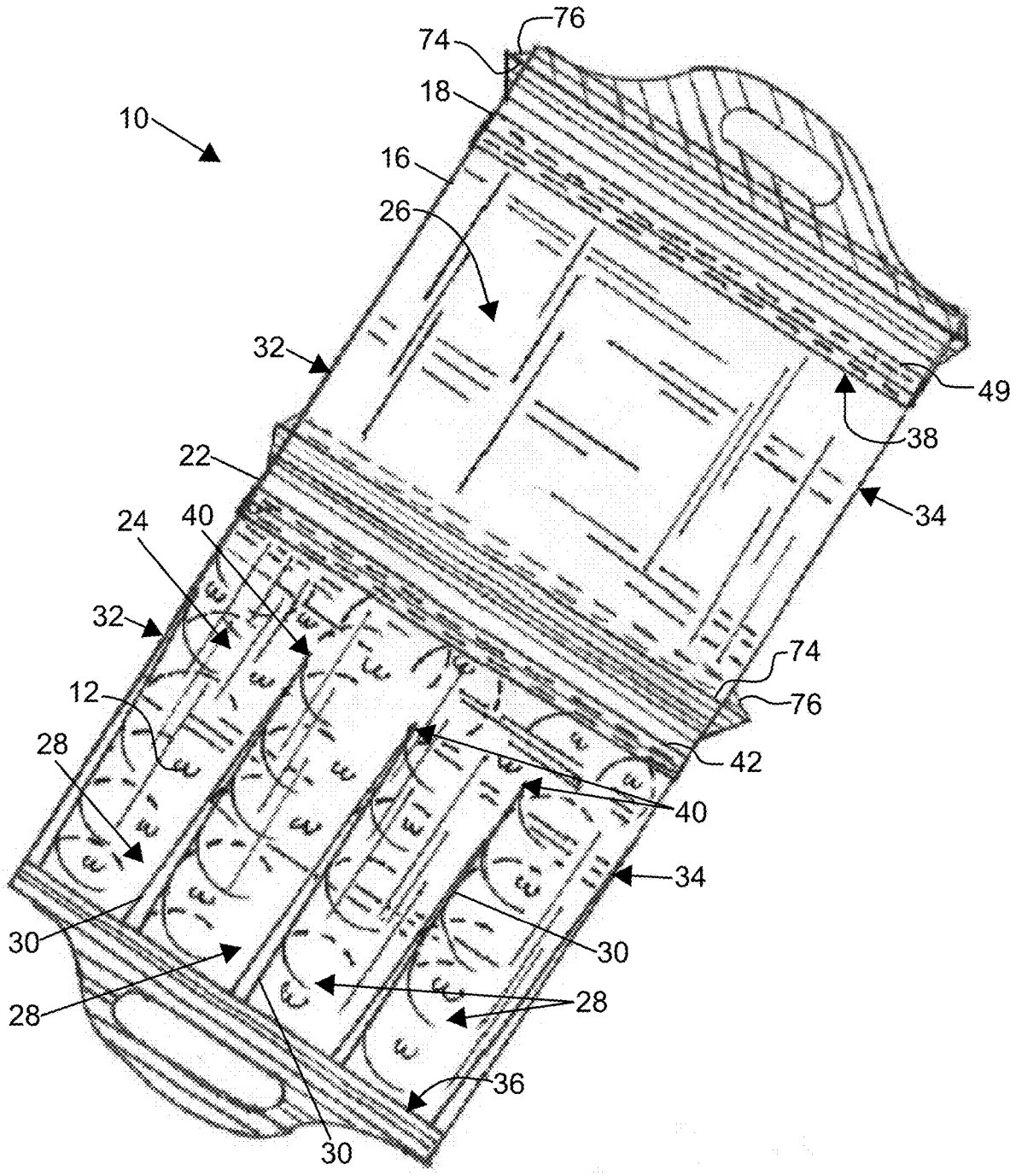
FIG. 2 is a perspective view of the container of FIG. 1 showing the reclosable main port fastener closed and the reclosable divider fastener closed.
Figure 3:
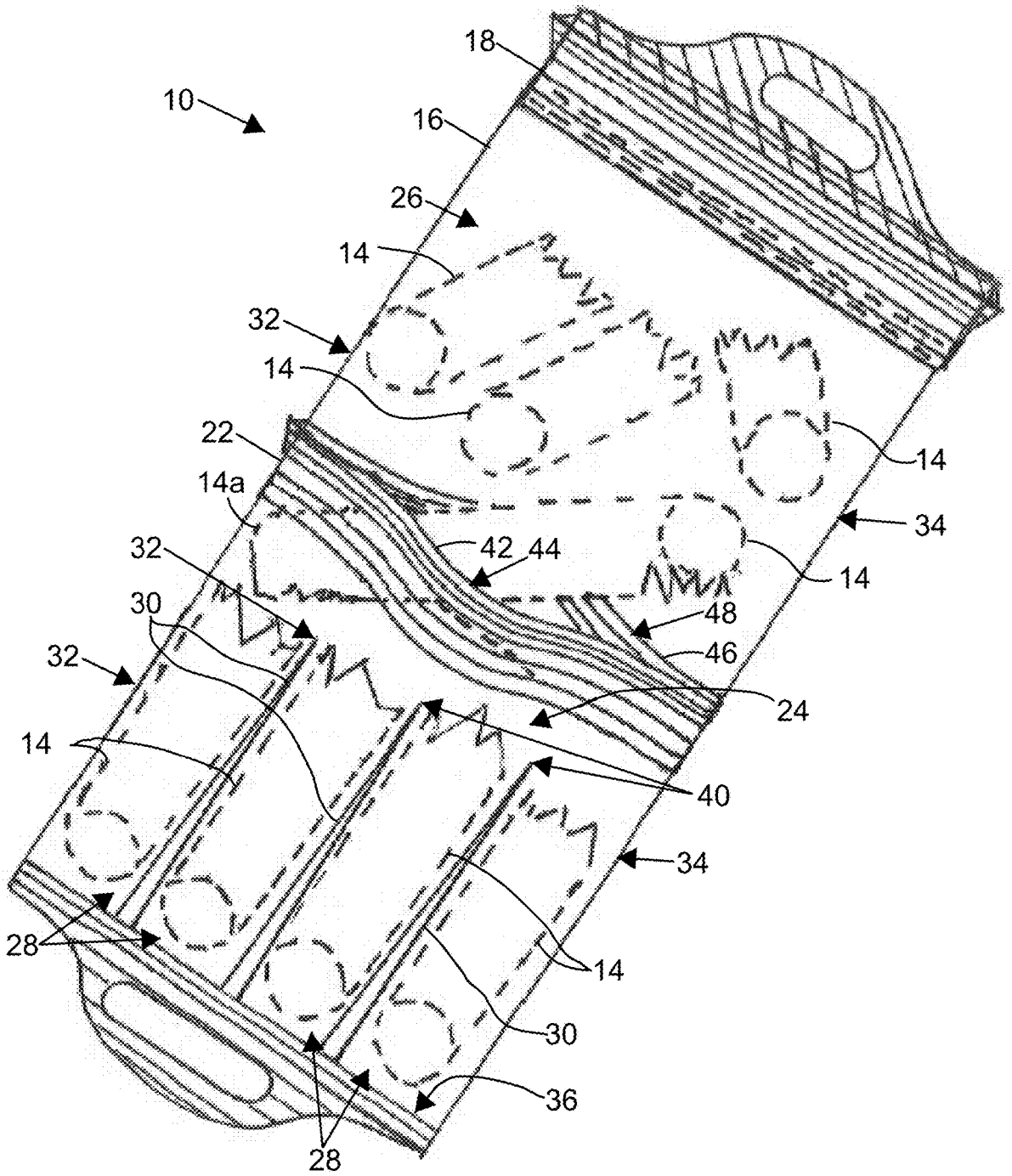
FIG. 3 is a perspective view of the container of FIG. 1 showing the reclosable main port fastener closed and the reclosable divider fastener open.

Referring now to the drawings and illustrative embodiments depicted therein, an ice-making container 10 is portable and versatile to readily freeze liquids 12 and store ice 14 formed by the liquids 12 and/or another source. The container 10 has a chamber 16 to support the liquids 12 and ice 14. (FIGS. 1-3). The liquids 12 and ice 14 enter and exit the chamber 16 via a port defined by a reclosable main port fastener 18 of the container 10 when the main port fastener 18 is open. (FIG. 1). When the main port fastener 18 is closed, the chamber 16 encloses the liquids 12 and ice 14 to prevent contaminants from outside of the chamber 16 contacting the liquids 12 and ice 14 and reduce or eliminate loss of ice 14 through sublimation, unlike a traditional ice tray having an open top. (FIGS. 2, 3). As such, the liquids 12 and ice 14 enclosed in the chamber 16 can be sanitarily transferred to and from a freezer 20 (FIG. 10) for freezing liquids 12 and storing ice 14.

The chamber 16 has a reclosable divider fastener 22 to divide liquids 12 and ice 14 between lower and upper regions 24, 26 defined by the chamber 16. (FIG. 2). The regions 24, 26 vary in the presence of barriers so that different sizes of ice 14 can form simultaneously in the regions 24, 26. (FIGS. 1-3). As shown in FIG. 1, the liquids 12 can enter the lower region 24 via openings defined by the main port fastener 18 and the divider fastener 22. The liquids 12 may be distributed within cavities 28 that are defined by barriers 30 disposed in the lower region 24 and coupled to the chamber 16. (FIGS. 1, 2). Liquids may further be distributed in the upper region 26 having no barriers and are separated from the liquids 12 in the lower region 24 by the divider fastener 22 when closed. The main port fastener 18 can be closed to transport the container 10 to the freezer 20 for forming smaller pieces of ice 14 in the lower region 24 (FIG. 3) and a larger piece of ice in the upper region 26.

The closed divider fastener 22 allows the chamber 16 to freeze liquids 12 in the lower region 24 while simultaneously storing ice 14 in the upper region 26. For example, after the liquids 12 enter the lower region 24 and the divider fastener 22 is closed (FIGS. 1, 2), ice may be directed into the upper region 26 via an opening or port defined by the open main port fastener 18 that is coupled to the chamber 16. The main port fastener 18 can then be closed for transporting the container 10 to the freezer 20 for freezing liquids 12 in the lower region 24 and storing ice 14 in the upper region 26.

Once liquids 12 freeze to ice 14 in the lower region 24, the divider fastener 22 can be opened for transferring ice 14 from the lower region 24 to the upper region 26. (FIG. 3). The ice 14 in the lower region 24 and/or the upper region 26 may be broken into smaller pieces by a user manually grasping and manipulating the chamber 16 or impacting the chamber 16 against another object. The ice 14 can be transferred out of the container 10 by opening the main port fastener 18. As such, the ice 14 frozen in the lower region 24 may exit the container 10 via openings defined by the divider fastener 22 and the main port fastener 18 when both are open. The divider fastener 22 and the main port fastener 18 open and close by manually grasping and manipulating only the exterior portions of the chamber 16, which reduces the risk of contamination by avoiding contact with the interior portions of the chamber 16.

Thus, the container 10 enables a user to separate and transfer the ice 14 and liquids 12 between regions 24, 26 of the chamber 16 while reducing risk of contamination by grasping and manipulating only the exterior portions of the container 10 to open and close the divider fastener 22. The divider fastener 22 allows liquids 12 to enter the lower region 24 for freezing, and then the divider fastener 22 can be closed so that ice 14 from an outside source can enter the upper region 26 for simultaneously storing ice 14. Additionally, the regions 24, 26 are separable by the divider fastener 22 so that liquids 12 in the lower region 24 having barriers 30 can form into smaller ice pieces, and liquids in the upper region 26 having no barriers can form a larger ice piece.

Referring to FIGS. 1-3, the divider fastener 22 extends from a left lateral side 32 of the chamber 16 to a right lateral side 34 of the chamber 16. The lateral sides 32, 34 extend from a lower opposing end 36 of the chamber 16 to an upper opposing end 38 of the chamber 16 so that the lateral sides 32, 34 and the opposing ends 36, 38 cooperate to define the entire periphery of the chamber 16. Although the periphery of the chamber 16 is shown in the drawings as a rectangular shape, it will be appreciated that the chamber may be any shape without departing from this disclosure.

As shown in FIG. 1, the chamber 16 has an upper opposing end 38 coupled to the main port fastener 18 that is openable to define a port for receiving liquids 12 from outside of the chamber 16. The main port fastener 18 extends along the entirety of the upper opposing end 38 and parallel with respect to the divider fastener 22, and is aligned with the divider fastener 22. The liquids 12 can enter the upper region 24 via a port defined by the open main port fastener 18 that is coupled to an upper chamber portion 39*a* of the chamber 16 defining the upper region 24. Liquids 12 can then enter the lower region 24 through an opening defined by the open divider fastener 22. The lower region 24 is defined by a lower chamber portion 39*b* of the chamber 16.

The liquids 12 in the lower region 24 distribute around the barriers 30 that are parallel and aligned with one another, and allow for expansion while the liquids 12 freeze. The barriers 30 extend perpendicularly from the lower opposing end 36 toward the divider fastener 22 and to respective endpoints 40 of the barriers 30. The respective endpoints 40 are spaced from the divider fastener 22 such that an undivided open area of the lower region 24 extends both between the endpoints 40 and the divider fastener 22 and between the lateral sides 32, 34.

The lower and upper regions 24, 26 extend between the lateral sides 32, 34 of the chamber 16 and are separated from one another by the divider fastener 22 when closed. The divider fastener 22 is disposed between the upper and lower chamber portions 39*a-b*, and closes by interlocking front and rear strips 42, 46 of the divider fastener 22 that are disposed on respective front and rear sidewalls 44, 48 of the chamber 16. (FIGS. 1, 2). As such, the divider fastener 22 selectively seals the front and rear sidewalls 44, 48 together along the divider fastener 22, and selectively separates the lower and upper regions 24, 26.

The main port fastener 18 can be closed by interlocking front and rear strips 49, 50 of the main port fastener 18 that are coupled to the front and rear sidewalls 44, 48, respectively. While the main port fastener 18 is closed, the divider fastener 22 can be opened so that ice 14 formed in the lower region 24 can be directed into the upper region 26 where the ice 14 can be broken into smaller pieces, if desired, by manipulating the chamber 16 without exposing the ice 14 to external contaminants.

Figure 8:
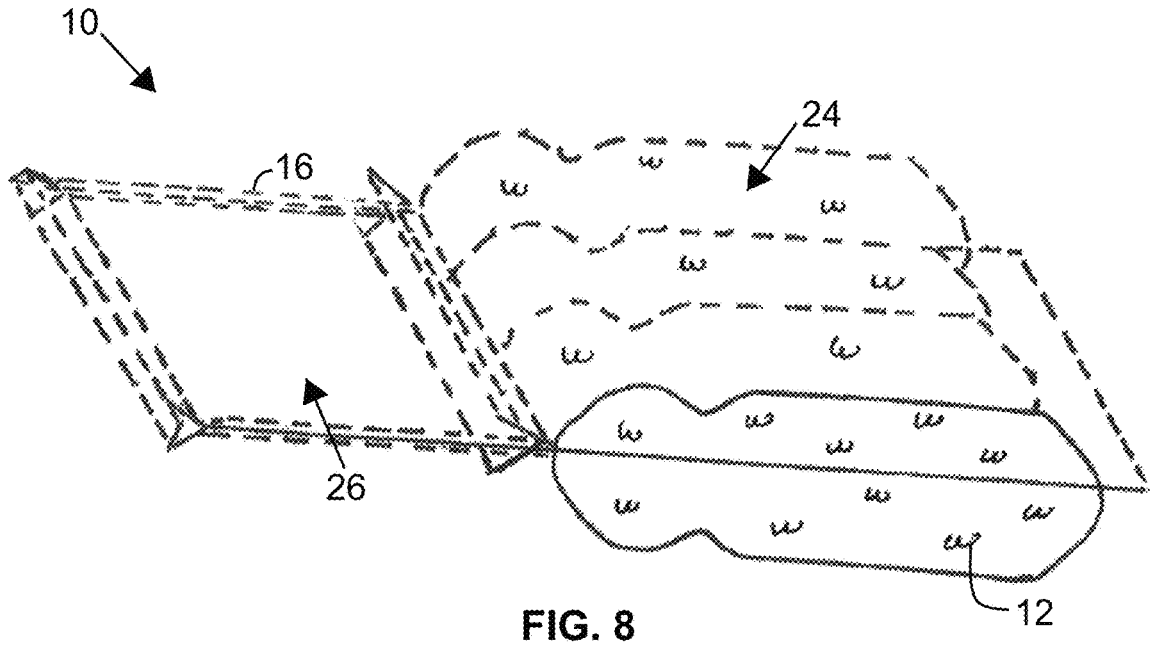
FIG. 8 is a perspective view of the container of FIG. 1 shown unfolded.
Figure 9:
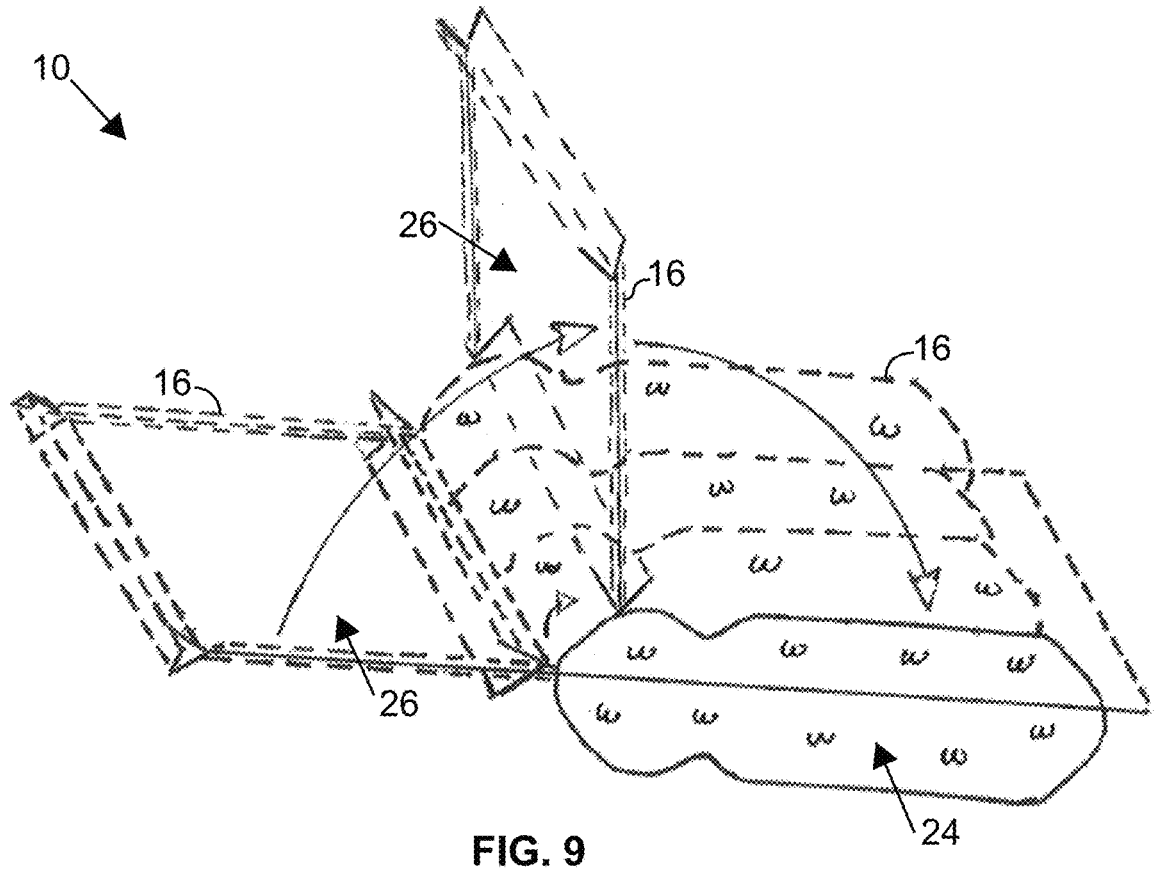
FIG. 9 is a perspective view of the container of FIG. 1 shown folding.
Figure 10:
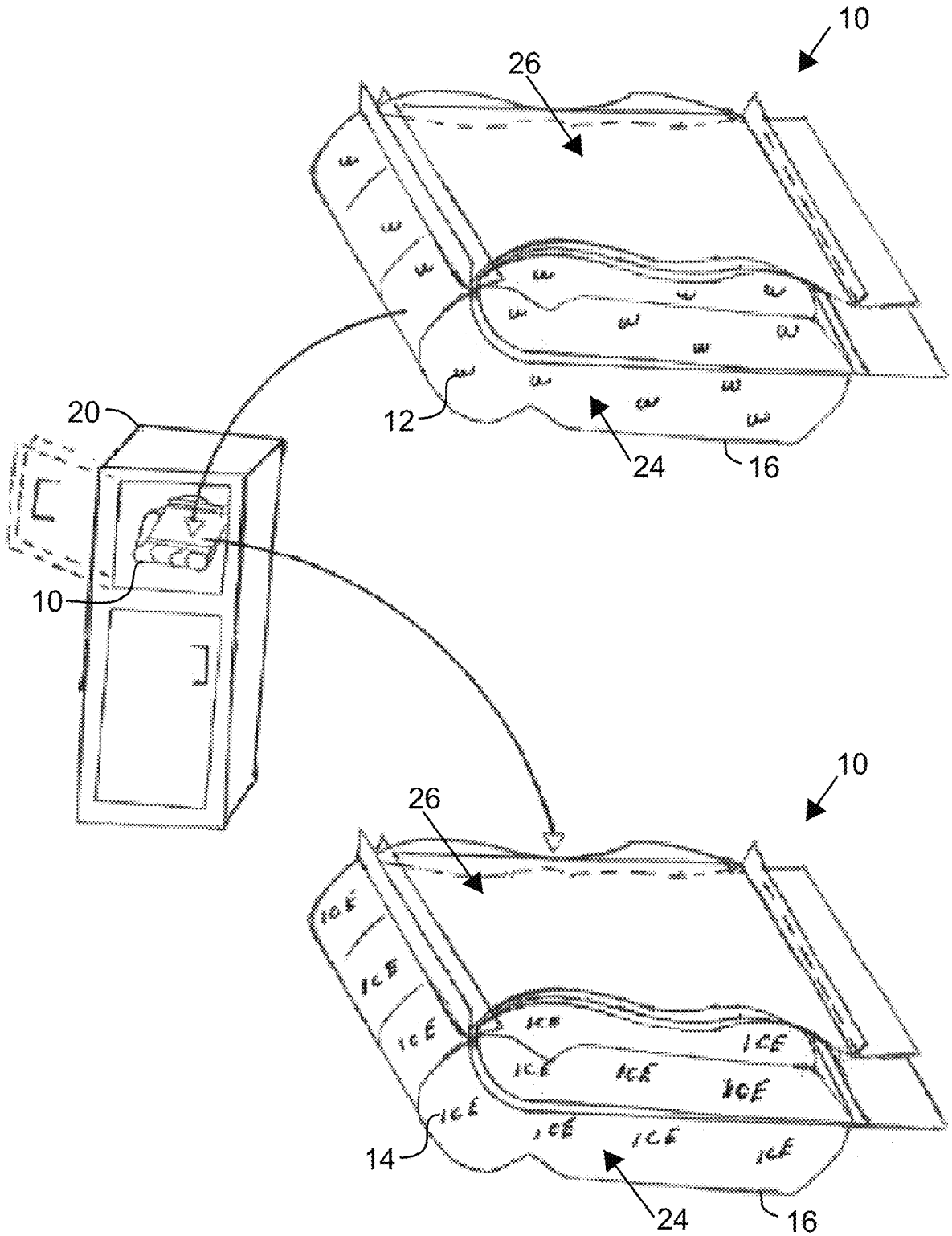
FIG. 10 is a perspective view of the container of FIG. 1 shown containing liquids when entering a freezer and shown containing ice when exiting the freezer.

The sidewalls 44, 48 are sealed along the lateral sides 32, 34 and the lower opposing end 36, and the sidewalls 44, 48 cooperate to define the entire exterior surface of the chamber 16. The portions of the sidewalls 44, 48 surrounding the regions 24, 26 are made of a flexible material (e.g., a flexible plastic sheet material) for versatility. Flexible sheet materials allow the chamber 16 to be folded for compact storage of chamber 16 in the freezer 20, such as shown in FIGS. 8-10. Optionally, the chamber 16 may be rolled for compact storage of the container 10 while not in use, in contrast to traditional rigid ice trays.

Figure 4:
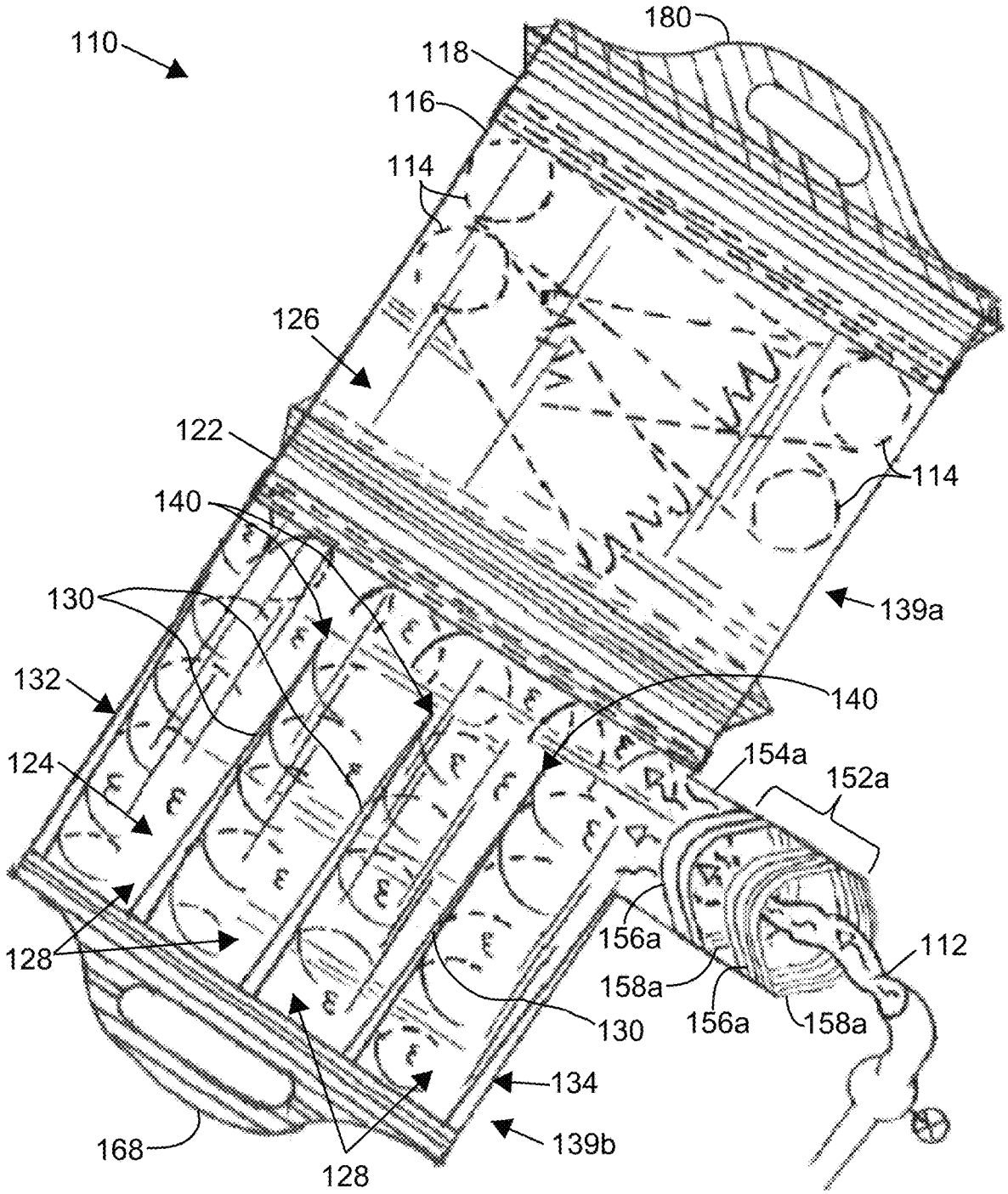
FIG. 4 is a perspective view of a container similar to the container of FIG. 1 and having another reclosable port fastener.

Referring to FIG. 4, another container 110 is similar to the container 10, with corresponding elements of the container 110 using like reference numbers having the same last two digits (e.g., a lower region 124 is the same or like the lower region 24). The container 110 has a reclosable right port fastener 152*a* that selectively defines a port fluidly coupled to the lower region 124 so that liquids 112 can be directed into the lower region 124 without passing through an upper region 126. The lower region 124 is designated for freezing liquids 112, and the upper region 126 is designated for storing ice 114 formed by the liquids 112 to iteratively produce ice in a sanitary manner.

The process of iterative ice-making begins by directing liquids into the lower region 124 and/or the upper region 126 via an open main port fastener 118 and/or via the open right port fastener 152*a*. The container 110 can enclose the liquids and can then be transported to the freezer for freezing the liquids in the lower region 124 and/or the upper region 126 to form a first batch of ice 114. The first batch of ice 114 can be enclosed in the upper region 126 before creating a second batch of ice 114 in the lower region 124.

In one example of beginning the process of iterative ice-making, liquids can be directed into both the lower and upper regions 124, 126 via the open main port fastener 118, and the liquids can distribute into both the lower and upper regions 124, 126. The main port fastener 118 can then be closed, and the container 110 can be transported to a freezer for freezing the liquids in the lower region 124 and the upper region 126. Ice formed in the lower region 124 can be directed into the upper region 126 to join the ice formed in the upper region 126 that together are the first batch of ice 114. The first batch of ice 114 can be enclosed in the upper region 126 by closing the divider fastener 122.

In another example of beginning the process of iterative ice-making, a divider fastener 122 can be closed, and liquids can be directed into the lower region 124 via the right port fastener 152*a* when open. The right port fastener 152*a* can then be closed, and the container 110 can be transported to the freezer for freezing the liquids in the lower region 124. Ice formed in the lower region 124 can be directed into the upper region 126 when the divider fastener 122 is open and the main port fastener 118 is closed. Such ice is the first batch of ice 114. The first batch of ice 114 can be enclosed in the upper region 126 by closing the divider fastener 122.

As shown in FIG. 4, after the first batch of ice 114 is enclosed in the upper region 126, liquids 112 can be directed into the lower region 124 via the open right port fastener 152*a*. The right port fastener 152*a* is coupled to a neck 154*a* that extends outwardly from a lower chamber portion 139*b* that defines the lower freezing region 124. As such, liquids 112 can enter the lower region 124 via the neck 154*a* and the open right port fastener 152*a* without contacting ice 114 stored in the upper region 124 when the divider fastener 122 is closed.

The right port fastener 152*a* can be closed by interlocking front and rear strips 156*a*, 158*a* of the right port fastener 152*a*, and then the container 110 can be transported to the freezer for freezing the liquids 112 in the lower region 124 while simultaneously storing the ice 114 in the upper region 126. After the liquids 112 freeze to form a second batch of ice in the lower region 124, the second batch of ice can be added to the first batch of ice 114 in the upper region 126 by opening the divider fastener 122 while the main port fastener 118 is closed.

This process can be repeated for any number of iterations until the desired amount of ice is produced or the upper region 126 is filled to capacity. Once the desired amount of ice is produced, a user can sanitarily transfer the ice directly from the upper storage region 126 to a beverage glass, for example, by grasping and manipulating external portions of the chamber 116. As such, the right port fastener 152*a* coupled to the lower chamber portion 139*b* and allows the container 110 to repeatedly produce ice in the lower region 124 while storing ice 114 in the upper region 126 and reducing risk of contamination.

Figure 5:
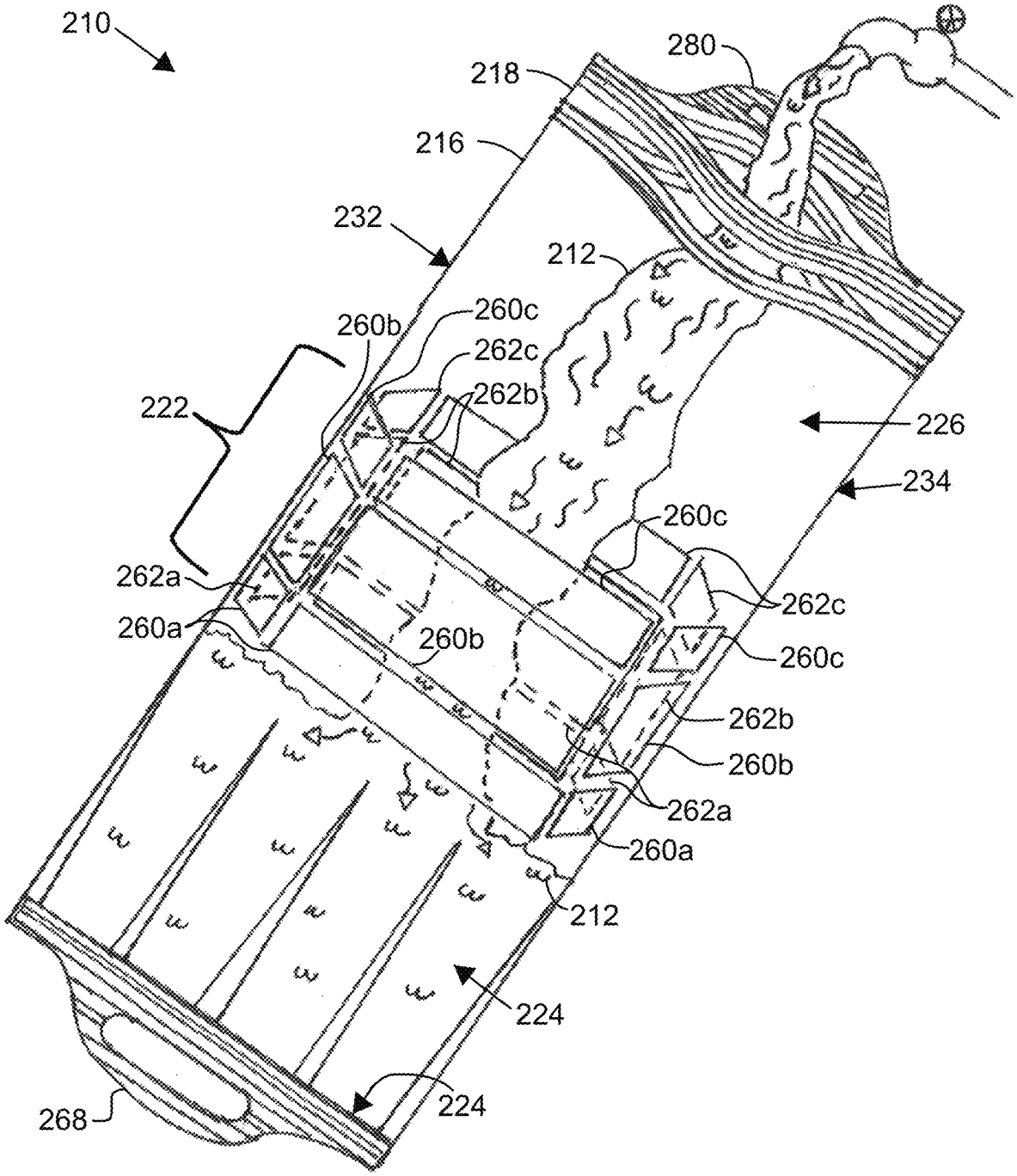
FIG. 5 is a perspective view of a container similar to the container of FIGS. 1 and 4, and having a reclosable divider fastener with stiffening panels.
Figure 6:
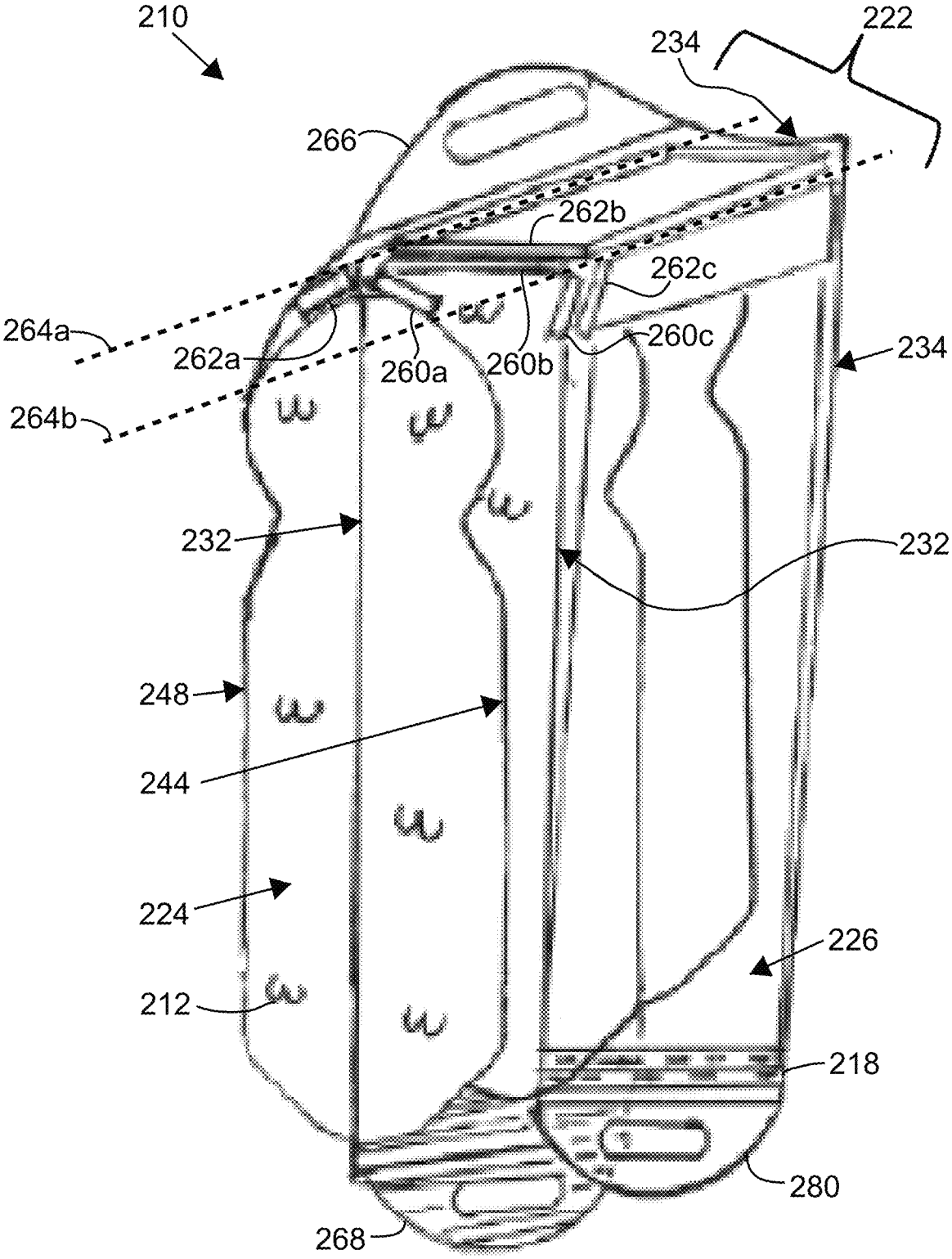
FIG. 6 is a perspective view of the container of FIG. 5 in a folded configuration.
Figure 7:
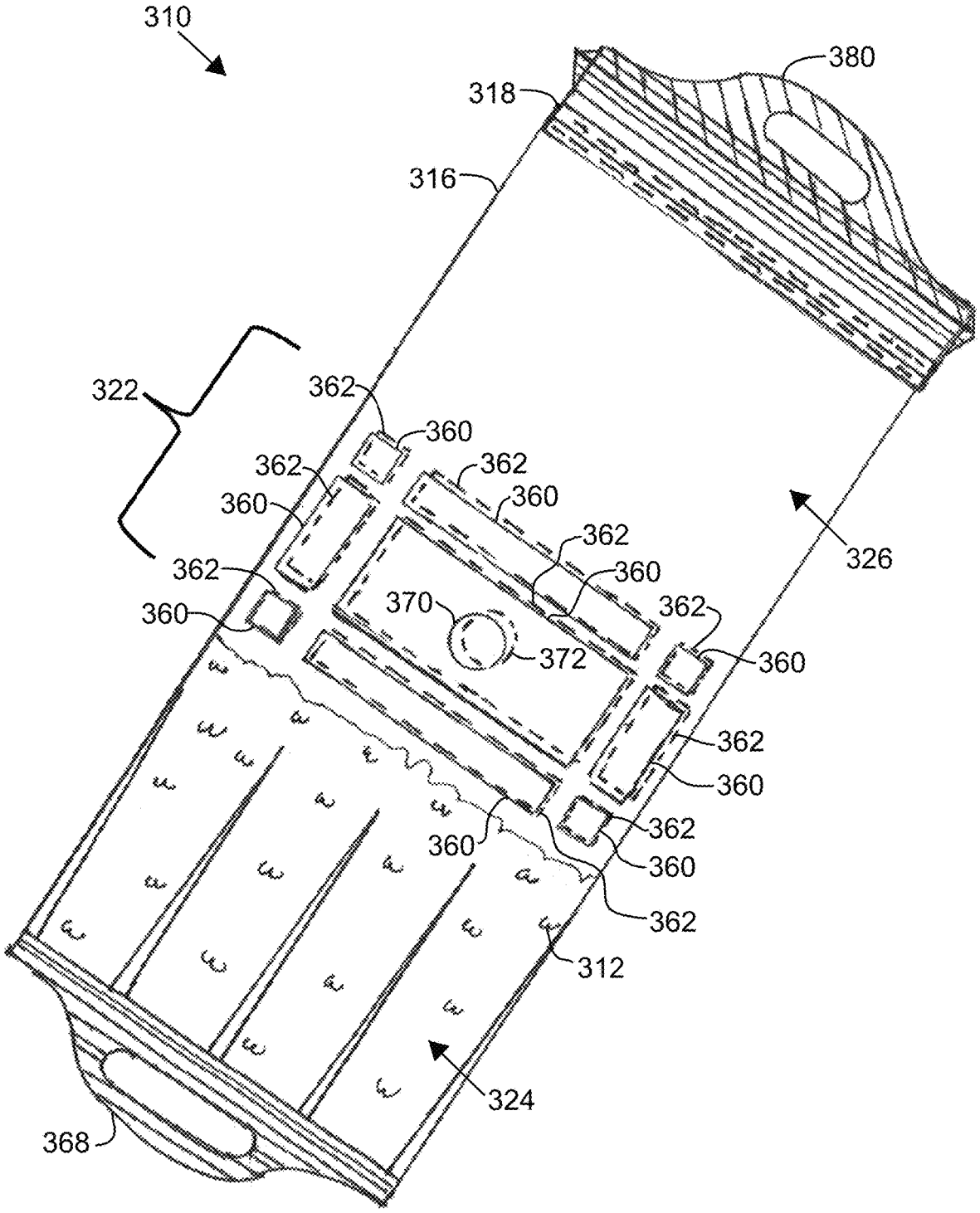
FIG. 7 is a perspective view of a container similar to the containers of FIGS. 1, 4, and 5, and including a reclosable divider fastener having stiffening panels with panel fasteners.

Referring to FIGS. 5 and 6, another container 210 is similar to the container 10, 110 with corresponding elements using like reference numbers having the same last two digits (e.g., a lower region 224 is the same and/or like the lower regions 24, 124). The container 210 has a divider fastener 222 that can be closed by folding a chamber 216 without relying on interlocking elements.

The divider fastener 222 can be closed by folding the chamber 216 about a first axis 264*a* that extends through a pair of lateral sides 232, 234. The chamber 216 folds about the first axis 264*a* between front lower and middle stiffening panels 260*a*, 260*b* of the divider fastener 222 that are disposed on a front sidewall 244, and between rear lower and middle stiffening panels 262*a*, 262*b* of the divider fastener 222 that are disposed on a rear sidewall 248. The front lower and middle stiffening panels 260*a*, 260*b* are aligned with respective ones of the rear lower and middle stiffening panels 262*a*, 262*b*.

The chamber 216 further folds about a second axis 264*b* parallel to the first axis 264*a* and extending through the lateral sides 232, 234. The chamber 216 folds about the second axis 264*b* between front middle and upper stiffening panels 260*b*, 260*c* of the divider fastener 222 that are disposed on the front sidewall 244, and between rear middle and upper stiffening panels 262*b*, 262*c* of the divider fastener 222 that are disposed on the rear sidewall 248. The front middle and upper stiffening panels 260*b*, 260*c* are aligned with respective ones of the rear middle and upper stiffening panels 262*b*, 262*c*. These panels 260*a-c*, 262*a-c* are of a more rigid material (e.g., stiffer, more resilient plastic) compared to the remaining portions of the chamber 216. The panels 260*a-c*, 262*a-c* allow the divider fastener 222 to be closed without needing to interlock pairs of like the divider fasteners 22, 122 described above.

As shown in FIG. 6, the container 210 has a divider handle 266 coupled to the rear sidewall 248 and extending along the first axis 264*a* so that the divider fastener 222 can be readily closed by supporting the container 210 with the divider handle 266. Optionally, the container 210 may be stored in a freezer by using the divider handle 266 to hang the container 210. After the liquids 212 freeze to ice, the container 210 can be supported by a lower handle 268 coupled to the lower opposing end 236 in a manner that causes the container 210 to unfold, with the lower region 224 vertically above upper region 226, and causes the gravitational force acting on the ice to open the divider fastener 222. The gravitational force directs the ice out of the lower region 224 and into the upper region 226 for storage while the main port fastener 118 is closed.

Figure 12:
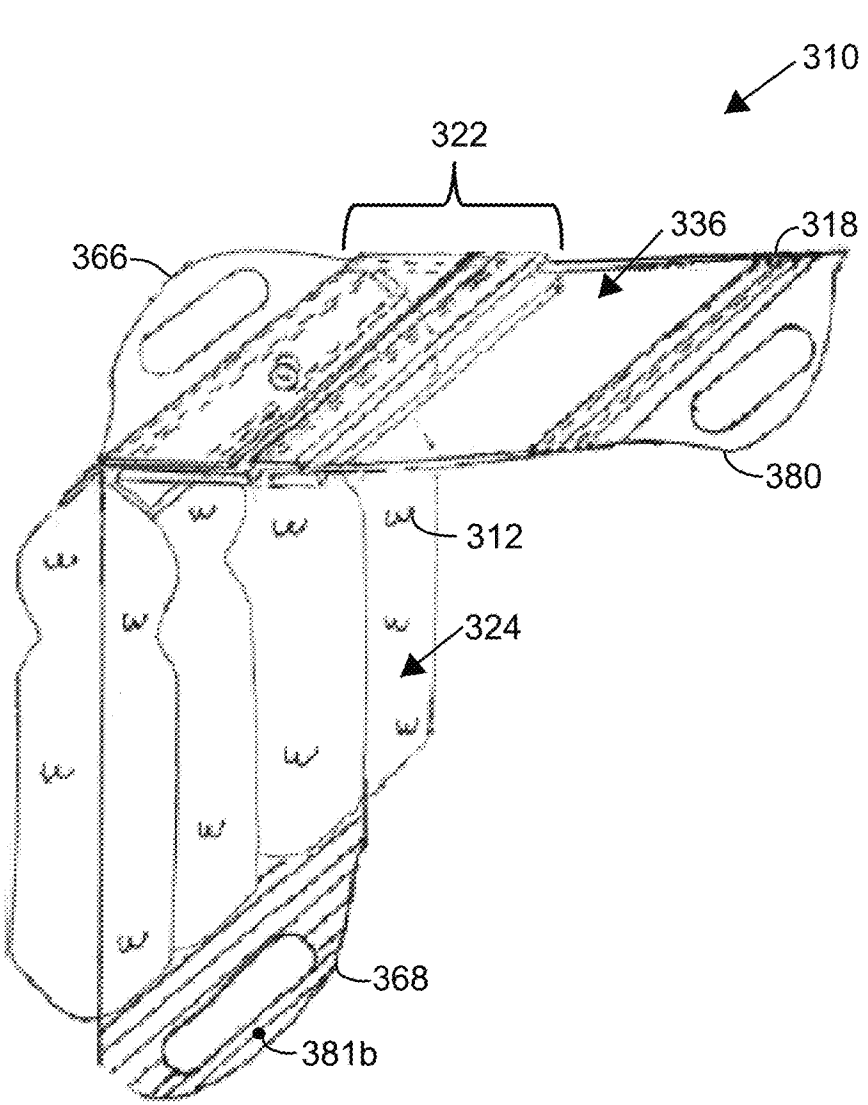
FIG. 12 is a perspective view of the container of FIG. 7 shown in the process of being folded.
Figure 11:
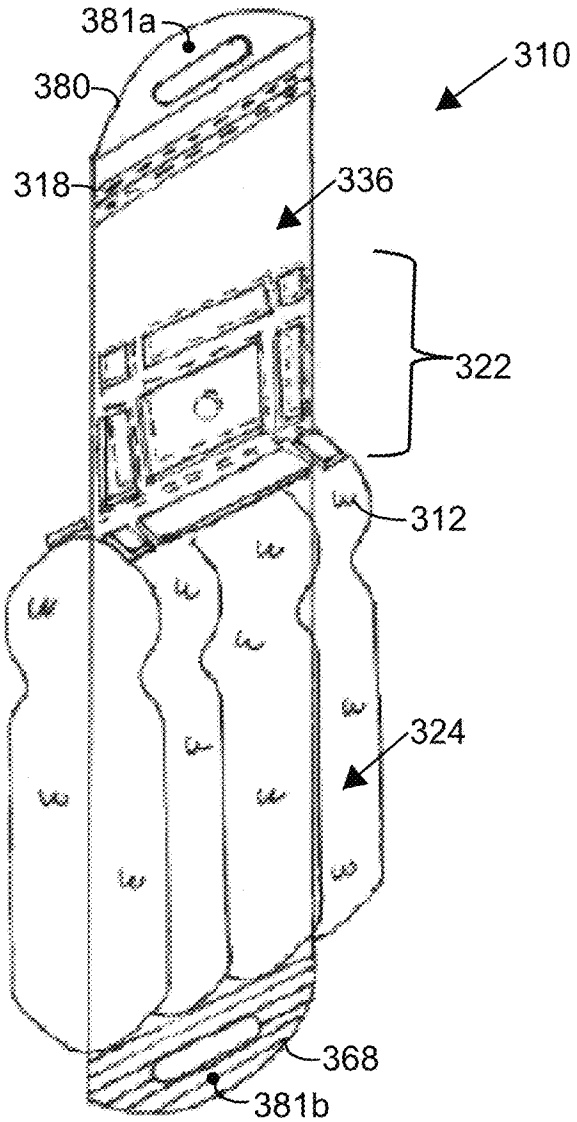
FIG. 11 is a perspective view of the container of FIG. 7 shown unfolded.
Figure 13:
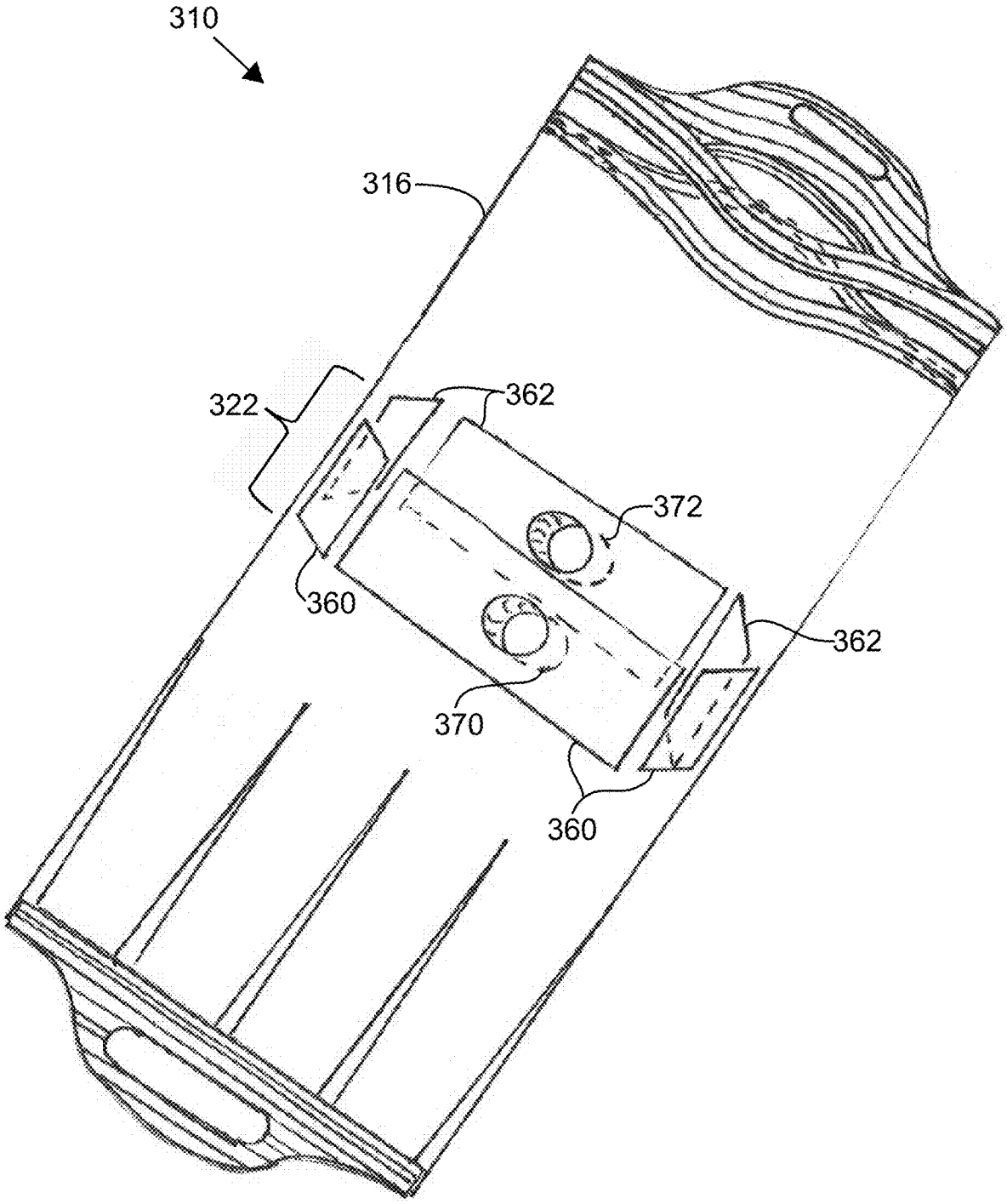
FIGS. 13-15 are perspective views of the container of FIG. 7 showing different stiffening panels.
Figure 14:
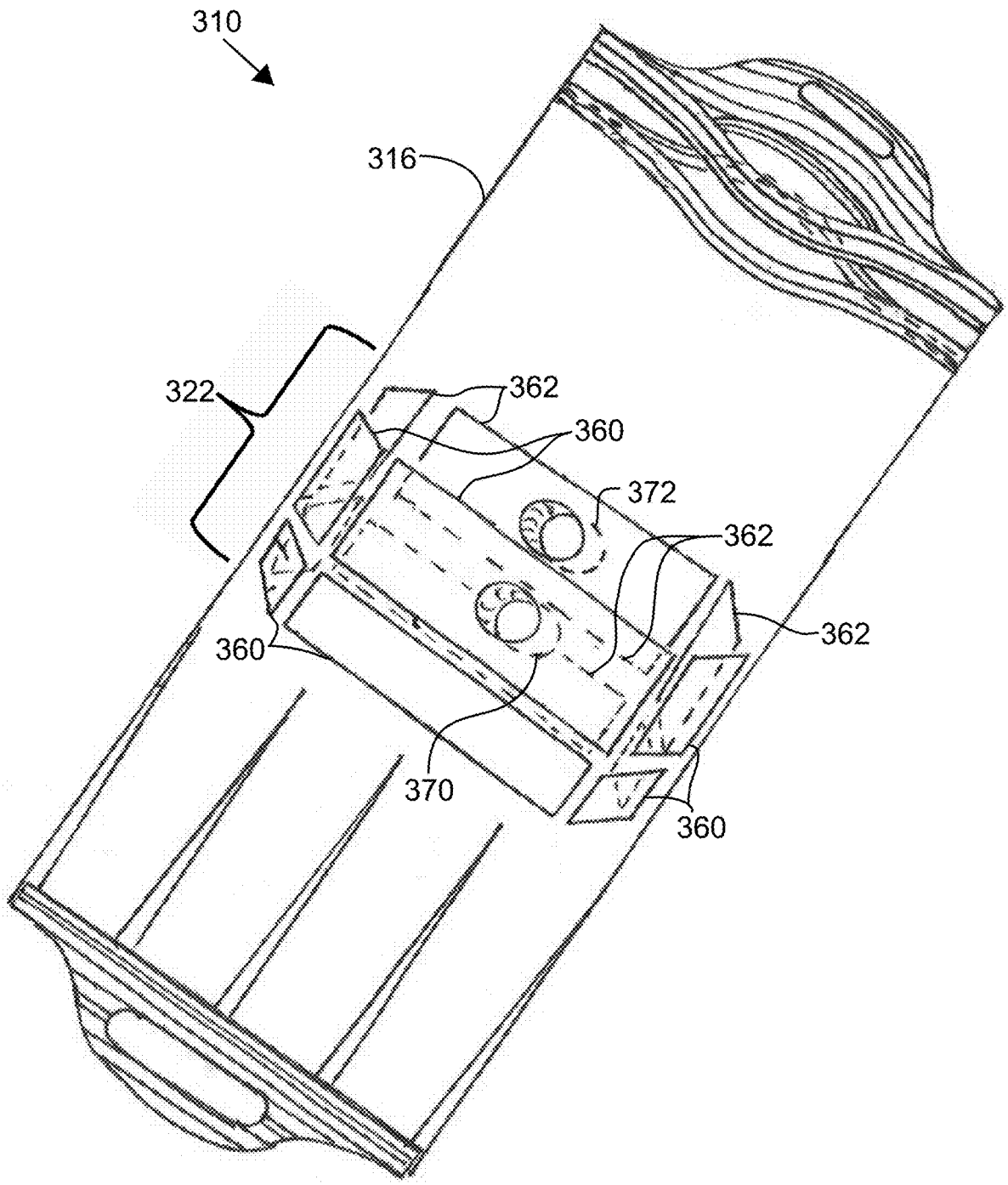

Referring to FIGS. 7 and 11-16, another container 310 is similar to the containers 10, 110, 210 with corresponding elements using like reference numbers having the same last two digits (e.g., a lower region 324 is the same and/or like the lower regions 24, 124, 224). The container 310 includes a divider fastener 322 having both a front panel fastener 370 coupled to one of the front panels 360 and a rear panel fastener 372 coupled to one of the rear panels 362 that are configured to interlock with one another to provide a more secure closure when the divider fastener 322 is closed. For example, the panel fastener 370 (e.g., a snap stud) and the panel fastener 372 (e.g., a snap socket) can be pressed together to interlock the panel fasteners 370, 372, and then the divider fastener 322 can be closed in a similar manner as the divider fastener 222. (FIGS. 11, 12).

The containers 210, 310 having respective divider fasteners 222, 322 with the respective panels 260*a-c*, 262*a-c*, 360, 362 may have reclosable port fasteners (not shown) coupled to the lower regions 224, 324, similar to the right port fastener 152*a* of the container 110 discussed above. As such, the containers 210, 310 may be used to repeatedly produce and store ice, similar to the container 110 used for iteratively producing ice as discussed above.

Figure 16:
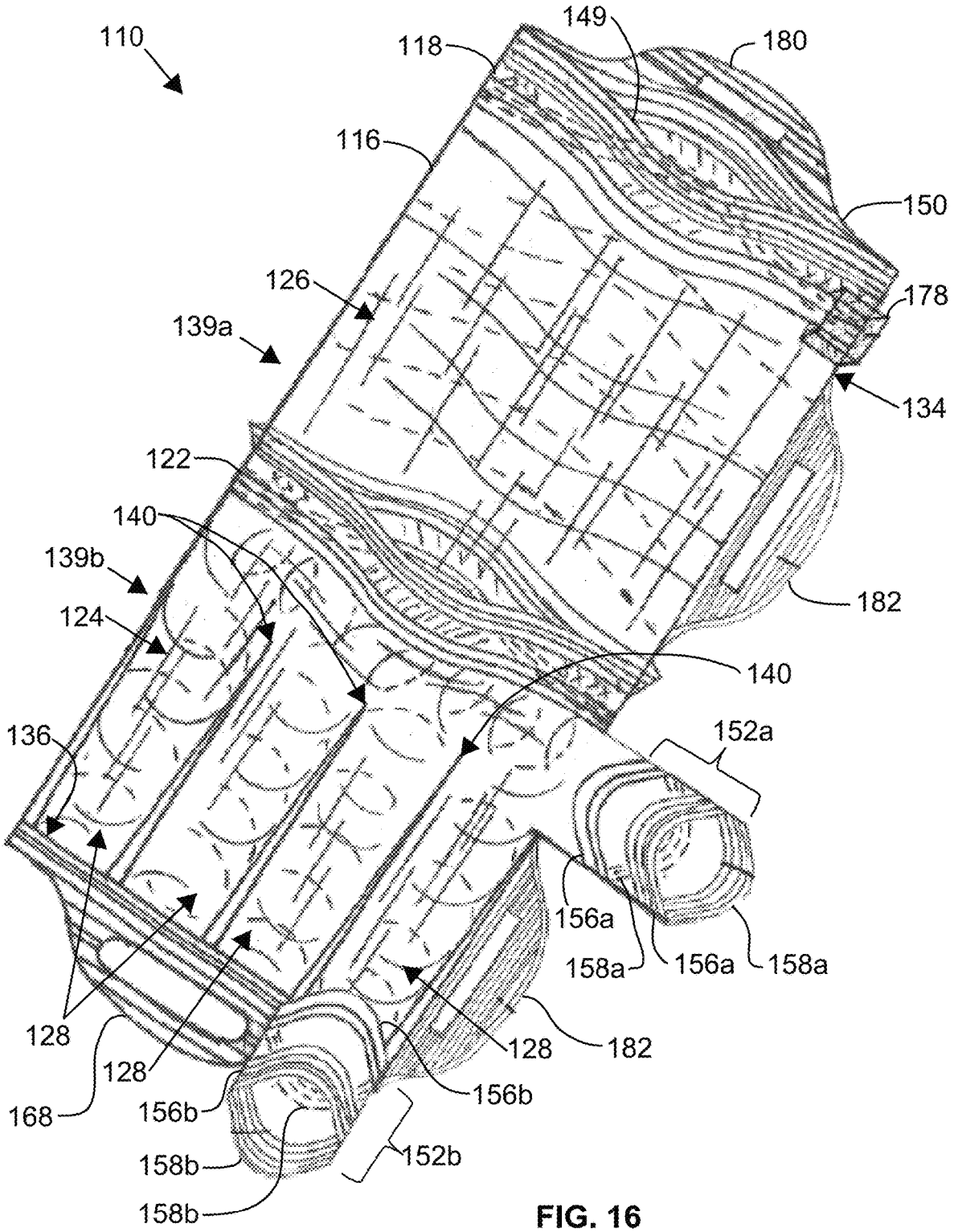
FIG. 16 is a perspective view of a container similar to the container of FIG. 4, having another reclosable port fastener.

Referring to FIG. 16, the container 110 includes a reclosable lower port fastener 152*b* coupled to the lower opposing end 136 and extending outwardly from the lower chamber portion 139*b* that defines the lower region 124 so that liquids can enter the chamber 116 via the open lower port fastener 152*b*. The open lower port fastener 152*b* defines an opening that is aligned with one of the cavities 128. The lower port fastener 152*b* has front and rear strips 156*b*, 158*b* that can be interlocked to close the lower port fastener 152*b*, similar to the pairs of strips 156*a*, 158*a* discussed above. The right port fastener 152*a* is coupled to the right lateral side 134 and extends along (i) either a portion of the open area (FIG. 4) or the entire open area (FIG. 16) of the lower region 124 that is defined between the endpoints 140 and the divider fastener 122, and (ii) a portion of the cavities 128.

The reclosable fasteners 18, 22, 152*a-b* can be closed by pressing together the front strips 42, 49, 156*a-b* and the respective ones of the rear strips 46, 50, 158*a-b* to interlock such pairs of strips. (FIGS. 1, 4, 16). The front strips 42, 49, 156*a-b* are pulled apart from the respective ones of the rear strips 46, 50, 158*a-b* to open the reclosable fasteners 18, 22, 152*a-b*. (FIGS. 1, 4, 16). The front strips 42, 49, 156*a-b* and the rear strips 46, 50, 158*a-b* may be coupled to external cantilever grip handles for assisting a user with opening the main port fastener 18, 118 and the divider fastener 22, 122 in place of or in addition to gravitational force as described above. For example, as shown in FIG. 2, the reclosable fasteners 18, 22 can be readily opened by grasping and pulling front cantilever grip handles 74 coupled to respective ones of the front strips 42, 49 and rear cantilever grip handles 76 coupled to respective ones of the rear strips 46, 50 away from one another. The grip handles 74, 76 may be a textured and flexible plastic sheet material to facilitate grasping and pulling the grip handles 74, 76. Optionally, the containers 210, 310 may have cantilever grip handles similar to the grip handles 74, 76 to readily open divider fasteners 222, 322 in place of or in addition to gravitational force as described above.

As shown in FIG. 16, the main port fastener 118 has a slider 178 that can slide in a closing direction to press the pair of strips 149, 150 together so that the strips 142, 146 interlock and the main port fastener 118 closes. The slider 178 can slide in an opening direction along the pair of strips 149, 150 to separate the pair of strips 149, 150 and open the main port fastener 118.

The main port fasteners 18, 118, 218, 318 are coupled to upper handles 80, 180, 280, 380 (FIGS. 1, 4, 5-7) that can be used to support the containers 10, 110, 210, 310 while liquids are directed into the respective chambers 16, 116, 216, 316 via the open main port fasteners 18, 118, 218, 318. As discussed previously, the divider and lower handles 266, 268 of the container 210 can be used to support the container 210 while opening and closing the divider fastener 222. (FIGS. 5, 6). The container 310 similarly has a divider handle 366 (FIG. 12) that can be used to support the container 310 while folding and storing the container 310. The containers 10, 110, 310 have lower handles 68, 168, 368 (FIGS. 1, 4, 7, 11-12, 16) that can be used to support the containers 10, 110, 310 while transferring ice from the lower regions 24, 124, 324. The upper handles 80, 180, 280, 380, the divider handles 266, 366, and the lower handles 68, 168, 268, 368 may be made of a flexible plastic sheet material. Optionally, the upper handles 80, 180, 280, 380 may have upper fasteners that can interlock with lower fasteners of the lower handles 68, 168, 268, 368 to assist in keeping the containers 10, 110, 210, 310 folded. For example, as shown in FIG. 11, the upper handle 380 has an upper fastener 381*a*, and the lower handle 368 has a corresponding lower fastener 381*b*. After the container 310 is folded, the upper fastener 381*a* and the lower fastener 381*b* can be pressed together to interlock the fasteners 381*a*, 381*b* to help ensure the container 310 remains folded.

Referring to FIG. 16, the lower handle 168 can be used to support the container 110 when liquids are directed into the upper region 126 via the open lower port fastener 152*b*. The container 110 has lateral handles 182 coupled to the right lateral side 134 that can be used for supporting the container 110 when the open right port fastener 152*a* receives liquids. (FIG. 16). In one example, the lateral handles 182 may be made of a flexible plastic sheet material.

Accordingly, the containers described herein have chambers defining multiple regions to improve versatility by allowing different sizes of ice to form simultaneously and/or liquids to freeze in one region while storing ice in another region. Ice can be transferred between regions by manually grasping and manipulating exterior portions of the container to improve the sanitation of ice-making. The chamber may have a reclosable port fastener coupled to one of the regions designated for freezing liquids so that liquids can enter the freezing region without contacting ice stored simultaneously in another region to repeatedly produce ice while reducing risk of contamination, and without the levels of evaporation or sublimation exhibited by traditional open-tray tops.

The containers can be assembled using methods currently available in freezer storage bag manufacturing such as, for example, plastic injection molding, bonding plastic sheet films, heat-welding, and/or ultrasonic welding. The containers can be made of one or materials such as, for example, flexible plastic sheet material, stiffer and more resilient plastic sheet materials, woven fiber, latex, rubber-like stretchable polymers, and/or moisture absorbent materials like of that used with medical ice compresses. For example, a woven fiber material can be applied to the exterior of the containers to reduce or prevent condensation from forming on the outside.

Figure 15:
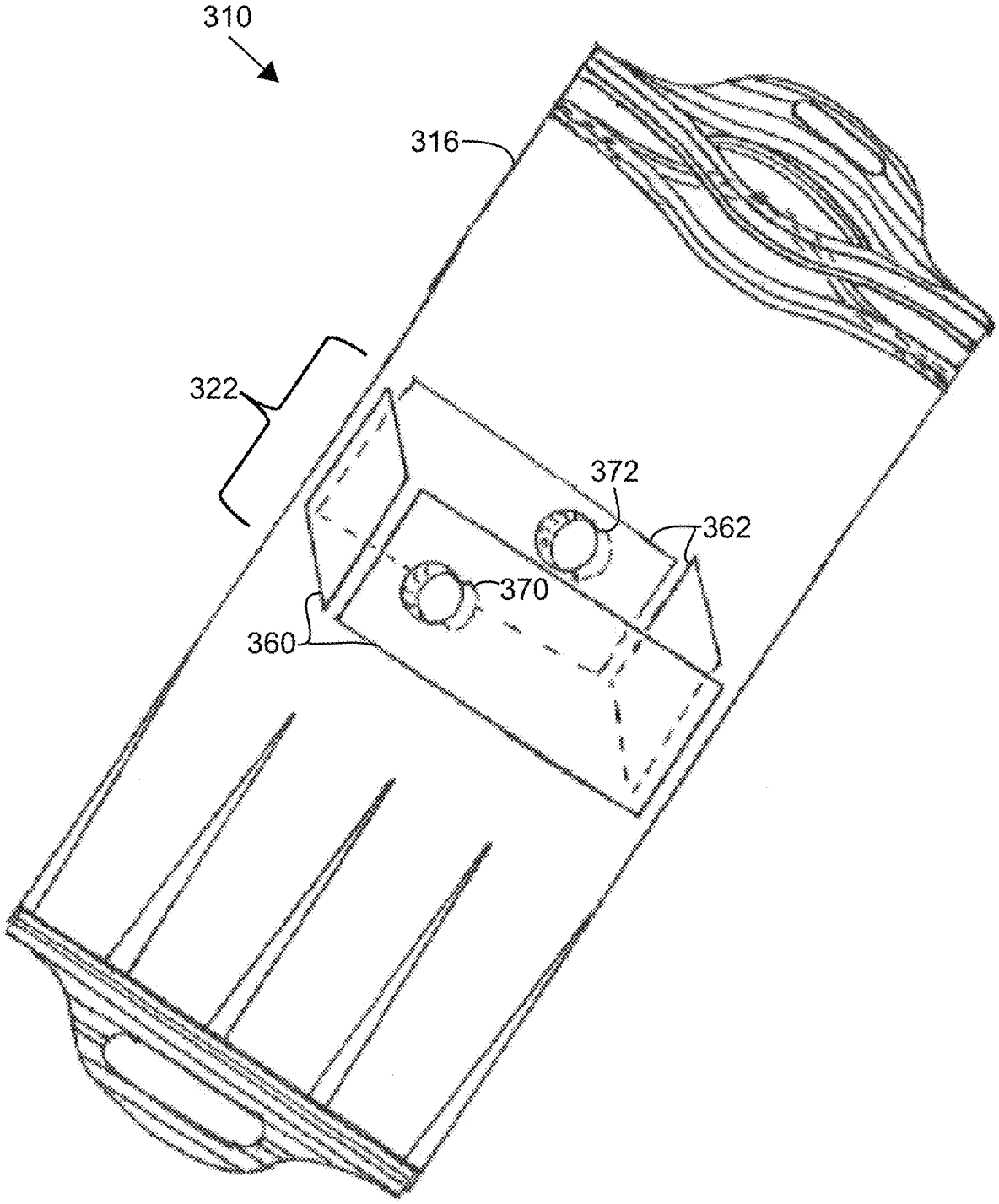

Although the container 10 shown in FIGS. 1-3 and 8-10, the container 110 shown in FIGS. 4 and 15, the container 210 shown in FIGS. 5-6, and the container 310 shown in FIGS. 7 and 11-15 share the same respective numbering systems, this does not imply such containers shown in their respective figures are identical, as the elements and/or configuration of such elements may differ. For example, the container 210 shown in FIGS. 5 and 6 share the same numbering system, yet the panels 260*a-c*, 262*a-c* vary. As noted above, similar elements of the containers 110, 210, 310 are marked with like reference numbers. However, not all similar elements of containers 110, 210, 310 may be discussed herein and/or annotated in the drawings.

While example implementations of the containers are shown in FIGS. 1-16, one or more of the elements illustrated in FIGS. 1-16 may be combined, divided, re-arranged, omitted, and/or implemented in any other way. For example, the handles 68, 80 and the grip handles 74, 76 may be omitted from the container 10. (FIGS. 1, 2). In another example, the upper region 126 may be significantly larger than the lower region 124 so that a larger amount of ice 114 can be stored. (FIG. 4). In yet another example, the main port fastener 118, the right port fastener 152*a*, and/or the barriers 130 may be coupled to portions of the chamber 116 differently than as shown in FIG. 4.

Further, the containers shown in FIGS. 1-16 may include one or more elements in addition to, or instead of, those illustrated in FIGS. 1-16, and/or may include more than one of any or all of the illustrated elements. For example, the container 110 may have one or more additional regions so that more liquids can be frozen and/or ice can be stored while simultaneously freezing liquids and/or storing ice in the lower and upper regions 124, 126. In another example, the right port fastener 152*a* may define threads so that a cap can screw onto the threads and close the right port fastener 152*a*.

It should be understood that "including", "comprising", and "having" (and all forms and tenses thereof) are used herein to be open-ended terms. Thus, whenever a claim employs any form of "include", "comprise", or "have" (e.g., comprises, includes, has, comprising, including, having, etc.) as a preamble or within a claim recitation of any kind, it is to be understood that additional elements, terms, etc. may be present without falling outside the scope of the corresponding claim or recitation.

As used herein, singular references (e.g., "a", "an", "first", "second") do not exclude a plurality. The term "a" or "an" entity, as used herein, refers to one or more of that entity. The terms "a" (or "an"), "one or more", and "at least one" can be used interchangeably herein. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C.

Spatial and functional relationships between elements are described using various terms, including "interlocked", "coupled", "cooperate", "disposed", "lateral", "upper", "lower", "left", "right", "front", "rear", "opposing", and "outward". Unless a relationship between first and second elements are explicitly claimed as being "direct", such relationship can be either a direct or an indirect relationship. A direct relationship is where no other intervening elements are present between the first and second elements, whereas an indirect relationship is where one or more intervening elements are present (either spatially or functionally) between the first and second elements.

Spatial relationships are used merely for convenience to facilitate understanding and describe relative positioning of the various elements, and are not to be limiting as it should be appreciated that the container may be used in any desired orientation. Thus, whenever elements are described as "lateral", "upper", "lower", "left", "right", "front", "rear", "opposing", or "outward" in the description and/or the claims, this does not limit the orientations of the container as other orientations of the container may be used.

Changes and modifications in the specifically described embodiments can be carried out without departing from the principles of the present disclosure which is intended to be limited only by the scope of the appended claims, as interpreted according to the principles of patent law including the doctrine of equivalents.

The invention claimed is:

1. A container for freezing liquids, said container comprising:

a chamber having first and second chamber portions that define respective first and second regions between first and second lateral sides of said chamber;

at least one reclosable divider fastener extending from said first lateral side to said second lateral side, and disposed between said first and second chamber portions;

a barrier disposed in said first region and configured to separate a liquid into a plurality of cavities; and a reclosable port fastener coupled to said chamber, wherein said reclosable port fastener is openable to define a port configured to receive the liquid from outside of said chamber;

wherein said chamber comprises first and second opposing ends extending between said lateral sides and cooperating with said lateral sides to define an entire periphery of said chamber;

wherein said barrier extends from said first opposing end to an endpoint of said barrier; and wherein said endpoint of said barrier is spaced from said at least one reclosable divider fastener that is closest to said endpoint to define an open area in said first region between said endpoint and said reclosable divider fastener that is closest to said endpoint; and wherein said open area is open to said plurality of cavities when said reclosable divider fastener that is closest to said endpoint is closed.

2. The container of claim 1, wherein said reclosable port fastener is coupled to said second opposing end and extends along the entirety of said second opposing end.

3. The container of claim 1, wherein:

said port is a first port, and said reclosable port fastener is a first reclosable port fastener coupled to said first chamber portion;

said container further comprises a second reclosable port fastener coupled to said second chamber portion; and said second reclosable port fastener is openable to define a second port configured to receive another liquid from outside of said container.

4. The container of claim 3, further comprising a neck extending outwardly from said first chamber portion, and wherein said first reclosable port fastener is coupled to said first chamber portion via said neck.

5. The container of claim 3, wherein said first reclosable port fastener extends along said first lateral side, and wherein said second reclosable port fastener is aligned with said at least one reclosable divider fastener.

6. The container of claim 1, wherein:

said at least one reclosable divider fastener comprises first and second panels;

said chamber further comprises first and second sidewalls extending between said lateral sides and cooperating to define said chamber;

said first sidewall comprises said first panel, and said second sidewall comprises said second panel that is aligned with said first panel; and said at least one reclosable divider fastener is configured to close by folding said chamber about an axis that extends through said first and second lateral sides.

7. The container of claim 6, wherein:

said first and second panels are first and second lower panels;

said first sidewall further comprises first middle and upper panels;

said second sidewall further comprises second middle and upper panels that are aligned with said first middle and upper panels, respectively;

the axis is a first axis;

said chamber is configured to fold between said first lower and middle panels and between said second lower and middle panels when folding about the first axis;

said at least one reclosable divider fastener is further configured to close by folding said chamber about a second axis extending through said first and second lateral sides; and said chamber is configured to fold between said first middle and upper panels and between said second middle and upper panels when folding about the second axis.

8. The container of claim 6, wherein said at least one reclosable divider fastener further comprises first and second panel fasteners coupled to said first and second panels, respectively, and wherein said first and second panel fasteners are configured to be interlocked when said at least one reclosable divider fastener is closed.

9. The container of claim 1, wherein said reclosable port fastener comprises a first pair of strips that are interlocked with one another to close said reclosable port fastener, and wherein said at least one reclosable divider fastener comprises a second pair of strips that are interlocked with one another to close said at least one reclosable divider fastener.

10. The container of claim 9, wherein said first pair of strips are parallel with respect to said second pair of strips.

11. The container of claim 1, wherein:

said port is a first port, the liquid is a first liquid, and said reclosable port fastener is a first reclosable port fastener coupled to said first opposing end;

said container further comprises a second reclosable port fastener coupled to said first lateral side; and said second reclosable port fastener is openable to define a second port configured to receive a second liquid from outside of said chamber.

12. The container of claim 11, further comprising a third reclosable port fastener coupled to said second opposing end, wherein said third reclosable port fastener is openable to define a third port configured to receive a third liquid from outside of said chamber.

13. The container of claim 12, and wherein said third reclosable port fastener when open defines an opening that is aligned with one of said cavities.

14. The container of claim 12, wherein said second reclosable port fastener extends along said open area.

15. A container for freezing liquids, said container comprising:

a chamber having first and second chamber portions that define respective first and second regions between first and second lateral sides of said chamber, and first and second sidewalls extending between said lateral sides and cooperating to define said chamber;

a reclosable divider fastener extending from said first lateral side to said second lateral side, disposed between said first and second chamber portions, and configured to close by folding said chamber about an axis that extends through said first and second lateral sides;

a barrier disposed in said first region and configured to separate a liquid into a plurality of cavities;

a reclosable port fastener coupled to said chamber, wherein said reclosable port fastener is openable to define a port configured to receive the liquid from outside of said chamber; and a handle coupled to said first sidewall, extending along the axis, and configured to support said container when folding said chamber;

wherein said reclosable divider fastener comprises first and second panels; and wherein said first sidewall comprises said first panel, and said second sidewall comprises said second panel that is aligned with said first panel.

16. A container for freezing liquids, said container comprising:

a chamber having first and second chamber portions that define respective first and second regions between first and second lateral sides of said chamber;

a reclosable divider fastener extending from said first lateral side to said second lateral side, and disposed between said first and second chamber portions;

a barrier disposed in said first region and configured to separate a first liquid into a plurality of cavities;

a first reclosable port fastener coupled to said chamber at said second chamber portion, wherein said first reclosable port fastener is openable to define a first port configured to receive the first liquid from outside of said chamber; and a second reclosable port fastener coupled to said first chamber portion;

wherein said first reclosable port fastener comprises a first pair of strips that are interlocked with one another to close said first reclosable port fastener, and wherein said reclosable divider fastener comprises a second pair of strips that are interlocked with one another to close said reclosable divider fastener; and wherein said second reclosable port fastener is openable to define a second port configured to receive another liquid from outside of said chamber, and comprises a third pair of strips configured to be interlocked with one another when said second reclosable port fastener is closed.

17. The container of claim 16, wherein said chamber further comprises first and second opposing ends extending between said lateral sides and cooperating with said lateral sides to define an entire periphery of said chamber, wherein said barrier extends from said first opposing end to an endpoint of said barrier, and wherein said endpoint is spaced from said reclosable divider fastener to define an open area in said first region between said endpoint and said reclosable divider fastener.

18. A container for freezing liquids, said container comprising:

a chamber having first and second lateral sides that extend between first and second opposing ends of said chamber, wherein said chamber further has first and second chamber portions that define respective first and second regions between said lateral sides and said opposing ends;

one and only one reclosable divider fastener extending from said first lateral side to said second lateral side, and disposed between said first and second chamber portions and directly along said first region, wherein said reclosable divider fastener is closable to divide said first region from said second region;

a first reclosable port fastener coupled to said first opposing end and said first chamber portion, wherein said first reclosable port fastener is openable to define a first port configured to receive first liquid from outside of said chamber;

a second reclosable port fastener coupled to said second chamber portion, wherein said second reclosable port fastener is openable to define a second port configured to receive second liquid from outside of said chamber; and a plurality of barriers disposed in said second region and extending from said second opposing end towards said first opposing end to a plurality of endpoints to define a plurality of cavities, wherein said endpoints are spaced from said reclosable divider fastener to define an open area in said second region between said endpoints and said reclosable divider fastener;

wherein said open area is open to said plurality of cavities when said reclosable divider fastener is closed.

19. A method for freezing liquids in a container, said method comprising:

directing a first liquid through an open port fastener of the container into a freezing region of the container;

closing the port fastener;

closing a divider fastener of the container to isolate the freezing region from a storing region of the container;

freezing the first liquid to form a first ice in the freezing region;

opening the divider fastener; and directing the first ice from the freezing region to the storing region.

20. The method of claim 19, wherein said directing the first ice comprises at least one of:

manually manipulating an exterior portion of the container to direct the first ice from the freezing region and into the storing region; and supporting the container with the freezing region vertically above the storing region so that gravitational force acting on the first ice causes the divider fastener to open and direct the first ice from the freezing region and into the storing region.

* * * * *